US006012504A

United States Patent [19]

Siegal

[11] Patent Number: 6,012,504

[45] **Date of Patent: *Jan. 11, 2000**

[54] VISUAL PRIVACY SYSTEM FOR OPEN PLAN FURNITURE ARRANGEMENTS

[76] Inventor: Burton L. Siegal, 7605 N. Tripp, Skokie, Ill. 60076

[ * ] Notice: This patent issued on a continued prosecution application filed under 37 CFR 1.53(d), and is subject to the twenty year patent term provisions of 35 U.S.C. 154(a)(2).

[21] Appl. No.: 08/615,149

[22] Filed: Mar. 14, 1996

[51] Int. Cl.[7] ..... A47H 1/00

[52] U.S. Cl. ..... 160/24; 160/89; 160/DIG. 8; 160/290.1; 292/162; 292/189; 292/244

[58] Field of Search ..... 160/23.1, 24, 26, 160/29, DIG. 7, 238, 323.1, DIG. 15, 315, 135, 351, 290.1; 292/341.19, 341.18, 189, 244, 162; 248/206.5; 52/239, 64, 222

[56] References Cited

U.S. PATENT DOCUMENTS

| | | | |
|---|---|---|---|
| 193,573 | 7/1877 | Tripp | 160/24 X |
| 354,450 | 12/1886 | Tripp | 160/24 |
| 376,436 | 1/1888 | Harrison | 160/24 |
| 388,161 | 8/1888 | Tripp | 160/24 |
| 778,228 | 12/1904 | Dodge et al. . | |
| 800,111 | 9/1905 | James . | |
| 1,371,149 | 3/1921 | Dudek . | |
| 1,958,695 | 5/1934 | Claus . | |
| 2,187,408 | 1/1940 | Thumm . | |
| 2,579,850 | 12/1951 | Nimkoff | 160/24 |
| 2,876,471 | 3/1959 | Kraemer . | |
| 2,915,151 | 12/1959 | Kekenak . | |
| 3,090,424 | 5/1963 | Carlo . | |
| 3,092,170 | 6/1963 | Ellis . | |
| 3,220,464 | 11/1965 | Wise | 160/24 |
| 3,487,874 | 1/1970 | Solo | 160/24 |
| 3,491,400 | 1/1970 | Hubbard . | |
| 3,500,894 | 3/1970 | Pofferi . | |
| 3,724,524 | 4/1973 | Potter | 160/24 |
| 3,842,890 | 10/1974 | Kramer . | |
| 4,124,196 | 11/1978 | Hipskind | 160/24 X |
| 4,480,676 | 11/1984 | Solomon . | |
| 4,480,862 | 11/1984 | Fleming . | |
| 4,609,173 | 9/1986 | Belokin | 248/206.5 X |
| 4,821,786 | 4/1989 | Johnston . | |
| 5,031,682 | 7/1991 | Tedeschi | 160/315 |
| 5,275,220 | 1/1994 | Siegal . | |
| 5,328,217 | 7/1994 | Sanders | 292/341.19 |
| 5,353,858 | 10/1994 | Hartmann | 160/DIG. 7 |
| 5,433,046 | 7/1995 | MacQuarrie et al. . | |
| 5,443,563 | 8/1995 | Hindel et al. | 160/DIG. 7 |
| 5,503,212 | 4/1996 | Lin | 160/24 |
| 5,579,608 | 12/1996 | Dunn . | |
| 5,675,946 | 10/1997 | Verbeek et al. . | |
| 5,778,612 | 7/1998 | Kissinger et al. . | |
| 5,873,205 | 2/1999 | Hanlon et al. . | |

*Primary Examiner*—Blair M. Johnson
*Attorney, Agent, or Firm*—Welsh & Katz, Ltd.

[57] ABSTRACT

A system to be utilized on a horizontal surface for providing visual privacy is disclosed. A plurality of base units each having a retractable panel are positioned at desired locations on the surface to define a plurality of intervals. Selected retractable panels can be drawn across selected intervals to form a desired grid system. The base units can be utilized in conjunction with an existing open plan furniture arrangement to provide additional visual privacy or workstations. In specific embodiments of the invention, the location at which the retractable panel is secured to a vertical panel is vertically adjustable, a uniform attachment between differing thicknesses of the flexible material of a retractable panel is maintained and the tension of spring loaded roller upon which the material is coiled is adjustable. The housing containing a retractable panel as well as the corresponding jamb member can be magnetically attached to vertical surfaces defined in an open plan furniture arrangement. Locking means is provided to allow a retractable panel to be locked in a closed position after it has been secured in that position.

23 Claims, 15 Drawing Sheets

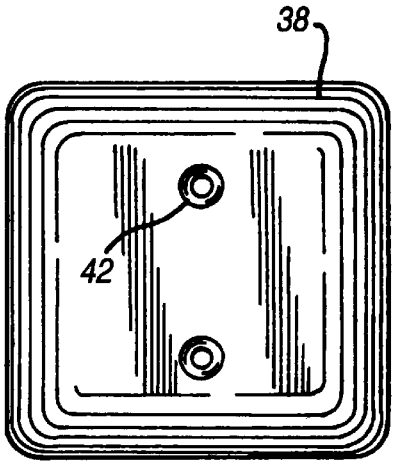
FIG. 4A
PRIOR ART
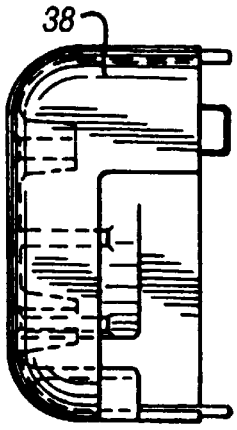
FIG. 4B
PRIOR ART
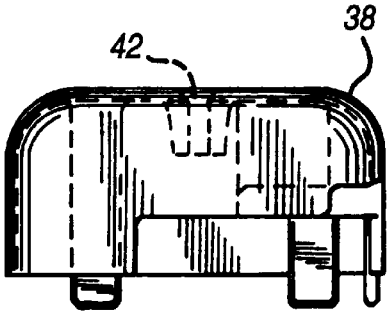
FIG. 4C
PRIOR ART
FIG. 5
PRIOR ART
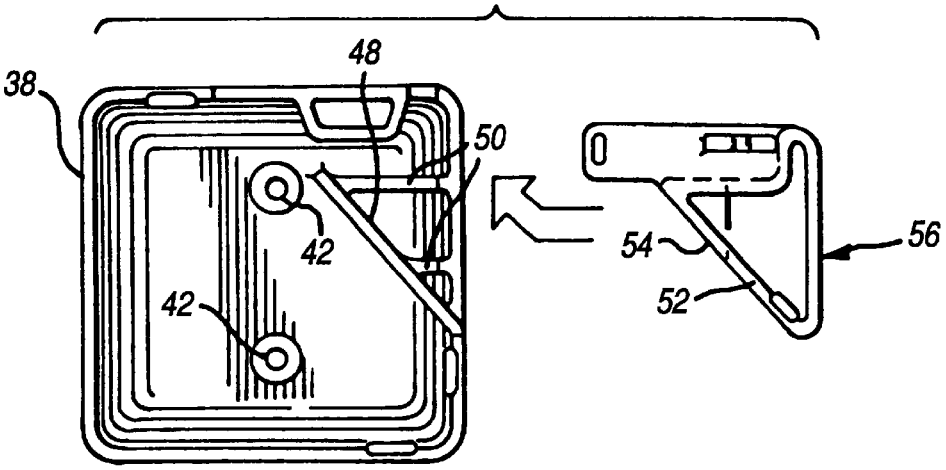

VISUAL PRIVACY SYSTEM FOR OPEN PLAN FURNITURE ARRANGEMENTS

BACKGROUND OF THE INVENTION

The present invention generally relates to open plan furniture arrangements and, more particularly, to an improved system for providing visual privacy in such open plan furniture arrangements.

A typical open plan furniture arrangement includes a plurality of vertically oriented panels that are positioned at predetermined locations on a horizontal surface which are connected together to define a workspace for a number of workers. Typically, a wide variety of other types of office furniture such as file cabinets, shelves and the like are used in conjunction with the vertical panels in the working environment.

U.S. Pat. No. 5,275,220 which issued to Burton L. Siegal on Jan. 4, 1994 discloses a visual privacy system for an open plan furniture arrangement. In this system, a horizontally retractable panel is situated at one side of an interval defined in the furniture arrangement, typically between a pair of vertical panels. The retractable panel can be drawn across the interval to a closed position and secured in that position to provide the desired visual privacy. This system is satisfactory for its intended uses. However, it is desirable to modify and improve the system to expand its capabilities and potential uses in addition to minimizing the problems associated its use.

For example, in U.S. Pat. No. 5,275,220, it is required that each retractable panel and jamb strip corresponding thereto be mounted to a vertical panel. An open plan furniture system permitting long, curving, irregular or straight temporary corridors or areas to be defined in a location where vertical panels might not exist is desirable, particularly in view of the increasing use of temporary task groups in the office environment.

In U.S. Pat. No. 5,275,220, a retractable panel is secured in a closed position to a jamb strip at a latching point which is disposed generally at the vertically symmetrical centerline of the retractable panel. Thus, the modular panels to which the housing and jamb strip are attached must be vertically aligned to prevent the retractable panel from buckling or drooping when deployed and latched. Furthermore, typical modular panels are provided with leveling glides at each end to allow them to be used on uneven or sloping surfaces. The two modular panels that define an interval are not normally vertically aligned with each other, but are aligned with those panels that are contiguous with them.

However, such vertical alignment compensation of a long run of panels over a wide, uneven surface can introduce vertical misalignment between any two adjacent panels that define an interval as great as three quarters of a inch. Thus , it is desirable to allow the vertical position of the latching point to be vertically adjusted to allow visual privacy to be provided even when the vertical panels are out of vertical alignment, such as when the furniture system is utilized on an uneven or sloping surface.

The retractable panels disclosed in U.S. Pat. No. 5,275,220 provide visual privacy for the user and blend in with the decor of the environment in which the system is used. In a typical application, an elasticized fabric which compliments the modular panels may be utilized. Such fabrics can be difficult to control when rolled and rerolled many times and can often develop unsightly stretched and sagging zones over time. Furthermore, the thickness of different types of elasticized fabrics can vary greatly which results in undesirable inventory and manufacturing problems related to attaching the fabrics to a spring loaded roller mounted inside a housing. Providing a uniform attachment between the material of the retractable panel to the spring loaded roller is desirable.

In U.S. Pat. No. 5,275,220, the torsion spring loaded roller is maintained at a predetermined tension to permit a retractable panel to be withdrawn from and retracted into a housing. To adjust the tension, a user would have to remove the end cap from the housing and an internal bracket to which the roller is mounted. Removing the internal bracket from the housing would result in a sudden and total free spinning of the tension spring without the user having any idea of what tension existed before the bracket was removed. Providing a user adjustable tension setting of a spring loaded roller in a visual privacy system is desirable.

The system disclosed in U.S. Pat. No. 5,275,220 provides visual privacy in an existing office environment. Free standing steel file cabinets, wardrobes and the like are increasingly used in typical office environments in conjunction with vertical panels. It is desirable to be able to mount and detachably couple the visual privacy system disclosed in U.S. Pat. No. 5,275,220 on such types of furniture in addition to vertical panels.

In U.S. Pat. No. 5,275,220, a person outside an enclosed workstation could gain access to the workstation so that, for example, that person could come to the aid of a suddenly stricken occupant. Thus, a user had to lock any confidential materials inside the workstation in a secure cabinet or the like to ensure the security of those materials. Thus, it is desirable to include a locking device with the visual privacy system to allow users to secure confidential materials and other items within a closed workstation when the user is not present.

SUMMARY OF THE INVENTION

The present invention comprises an open plan furniture arrangement which is intended to be utilized on a horizontal surface to define a desired grid system, preferably a network of offices or workstations. A plurality of base units each having a retractable panel associated therewith are to be positioned at desired locations on the surface to define a plurality of intervals. Selected retractable panels can be drawn across selected intervals to form the desired grid system. Additionally, the base units can be utilized in conjunction with an existing furniture arrangement and linked to a number of vertical surfaces defined therein to provide additional visual privacy or workstations.

In one embodiment of the invention, the location at which a retractable panel and the surface to which the retractable panel is secured in a closed position is vertically adjustable. Allowing the securing location to be vertically adjusted permits a grid system to be defined on an uneven surface and allows two modular vertical panels which form an interval across which a retractable panel is drawn to be out of vertical alignment.

A further embodiment of the present invention involves a uniform attachment between the flexible material of the retractable panel and the spring loaded roller about which the material is coiled. The flexible material has a first end and comprises a first material layer laminated to a second material layer which extends beyond the first layer at the first end of the flexible material. A crimp is secured to the extending end of the second material and is slidably engagable with a longitudinal channel in the roller to secure the flexible material to the roller.

A locking means can be provided to allow a retractable panel to be locked in a closed position after it has been secured in that position so that any confidential materials located within an enclosed workstation can be secured when a user is not present.

The tension of the spring loaded roller can be adjusted according to an embodiment of the invention. The roller includes a tension adjusting blade and is mounted within a housing which includes an end plate detachably secured thereto. The end plate receives the blade so that a desired tension is maintained on the roller when the end plate is secured to the housing. The end plate also includes means for allowing the desired tension to be changed by detaching the end plate from the housing, rotating the end plate and blade relative to the housing, and re-securing the end plate to the housing once a new desired is reached.

A further embodiment of the invention allows the housing and jamb member to be magnetically attached to vertical surfaces defined in the open plan furniture arrangement to allow visual privacy to be provided across an interval defined therein even when the vertical panels are out of vertical alignment.

BRIEF DESCRIPTION OF THE DRAWINGS

FIGS. 3A–8 correspond to FIGS. 3–11 of U.S. Pat. No. 5,275,220, the brief descriptions of these drawings hereby being incorporated by reference.

FIG. 12A is an elevational view of the housing with portions broken away and truncated in length for illustrative purposes in which the edge member is retracted. FIG. 12B is a similar type of view of the deployed edge member engaged with a jamb member. FIG. 12C is a partial cross-sectional view of the adjustable means illustrated in FIG. 12B, taken along lines 12C—12C.

DETAILED DESCRIPTION OF THE PREFERRED EMBODIMENTS

Figure 1:
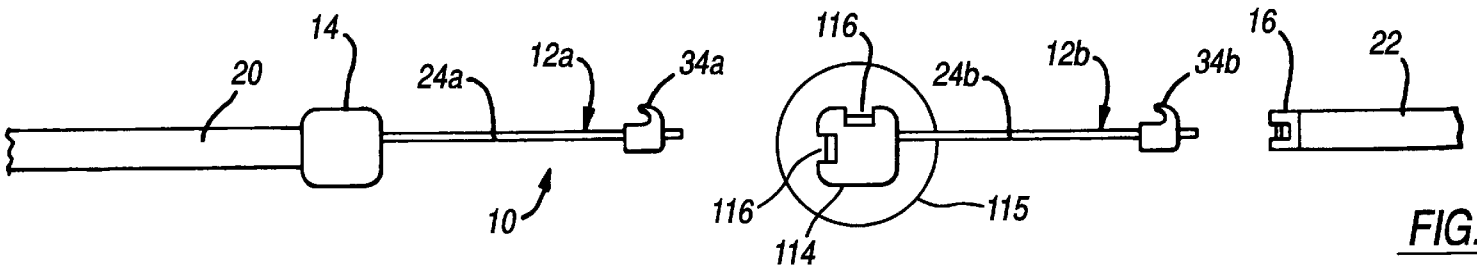
FIGS. 1 and 2 are top plan schematic and front elevational views of a system according to the invention when employed in an interval in an open plan furniture arrangement, and with the retractable panels partially deployed.
Figure 2:
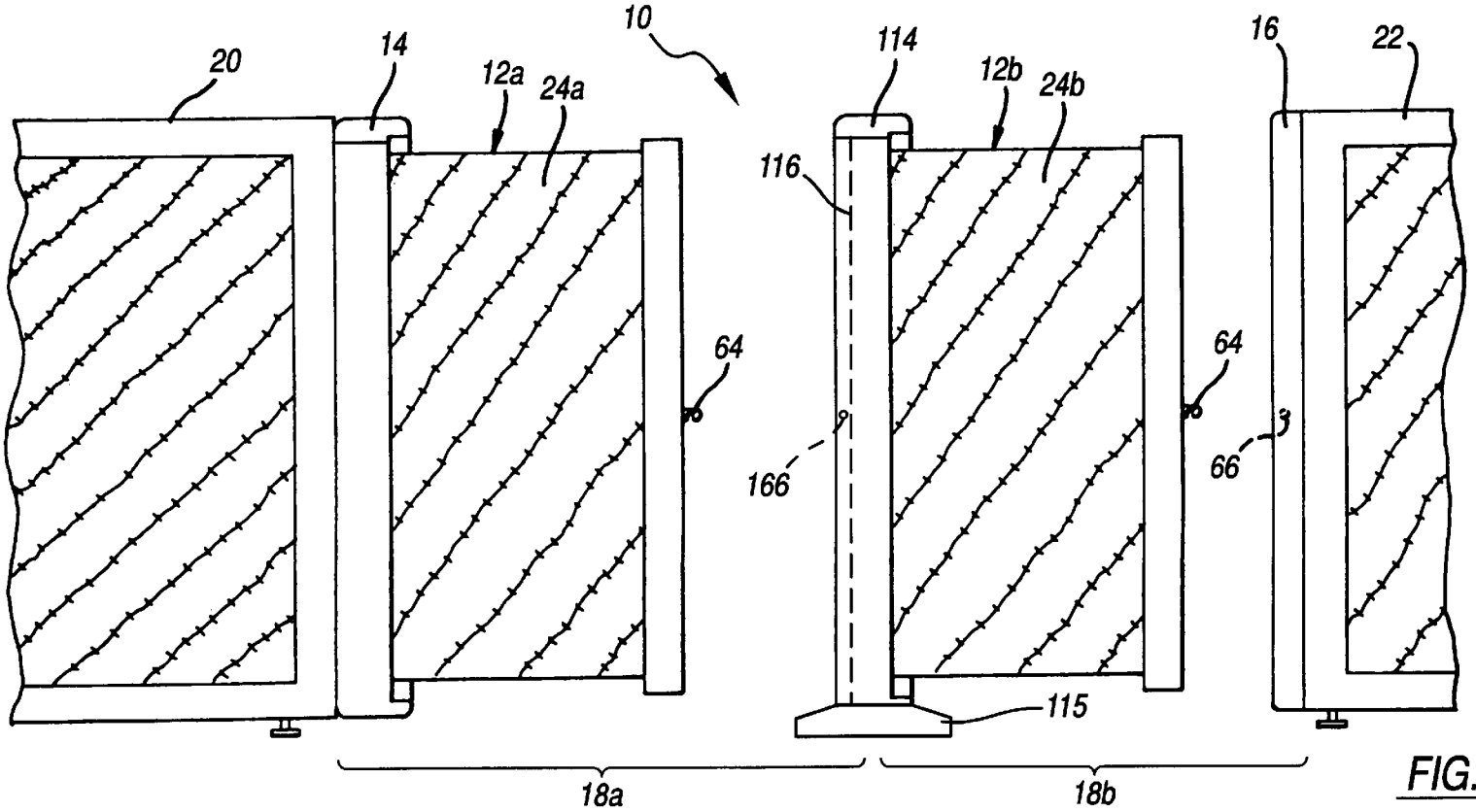

Referring to FIGS. 1 and 2, an improved visual privacy system for an open plan furniture arrangement is shown in schematic form generally at 10. U.S. Pat. No. 5,275,220 which issued on Jan. 4, 1995 to Burton L. Siegal discloses a known visual privacy system for open plan furniture arrangements. Because the present invention comprises a number of improvements over the visual privacy system disclosed in U.S. Pat. No. 5,275,220, its disclosure is hereby incorporated by reference.

Figure 3A:
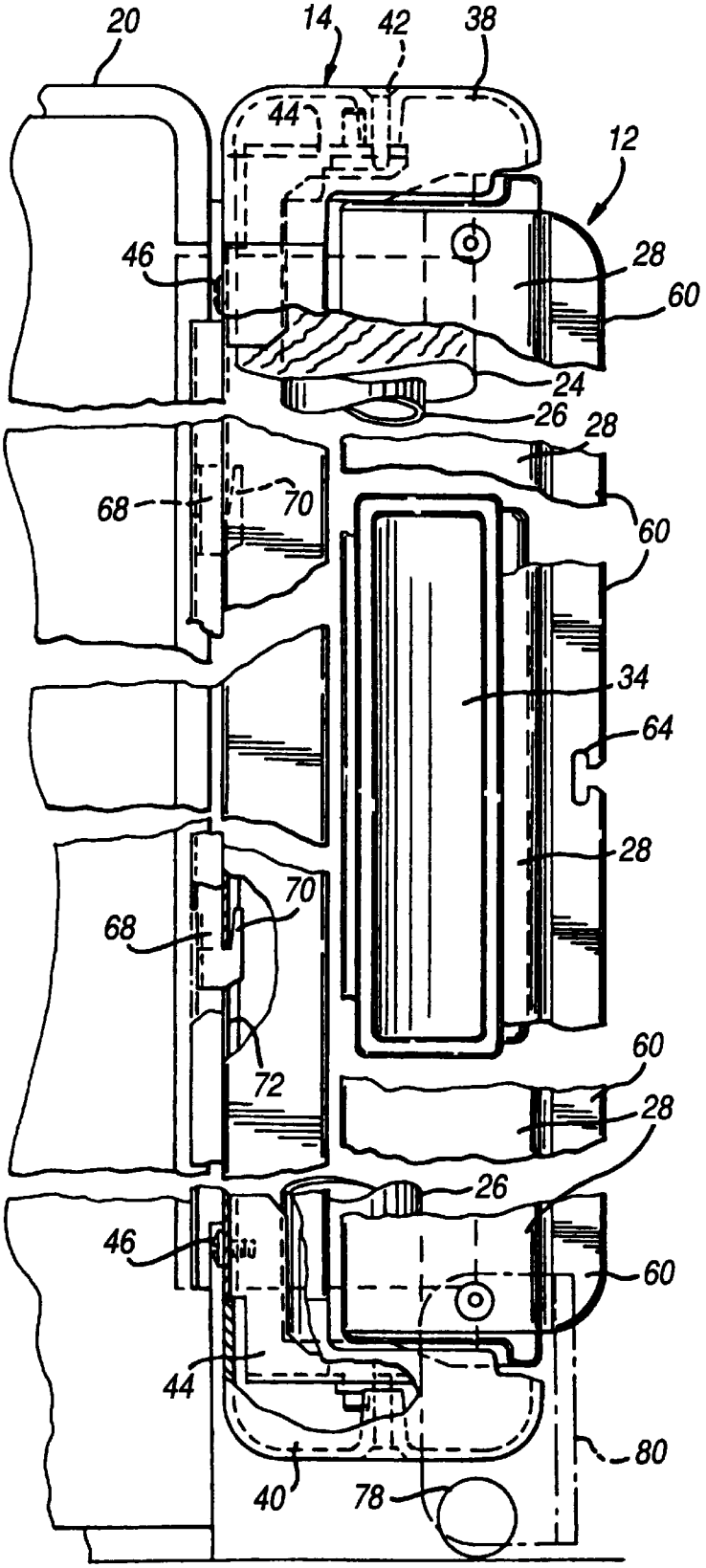
FIG. 3A PRIOR ART
Figure 3B:
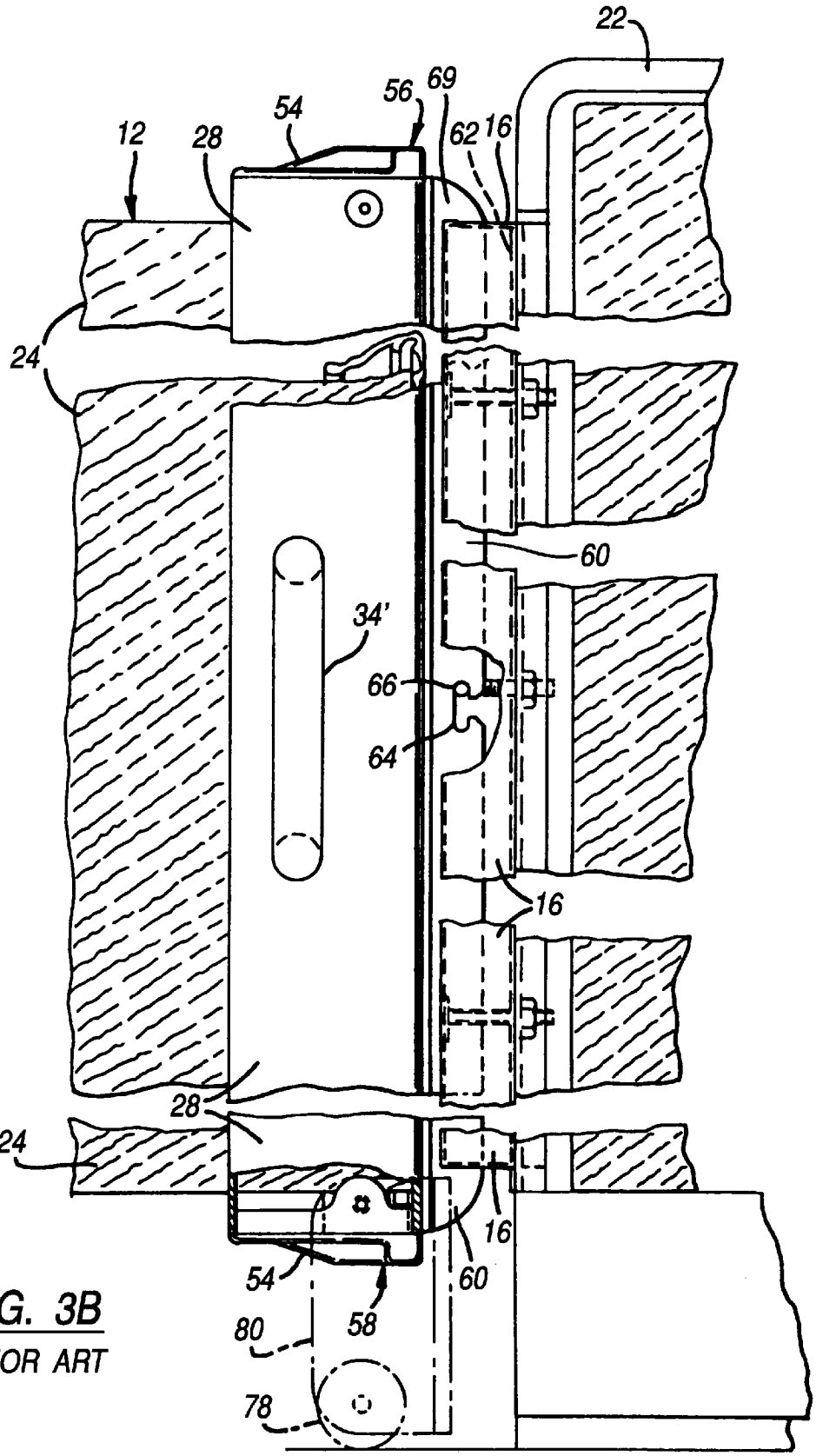
FIG. 3B PRIOR ART
Figure 9:
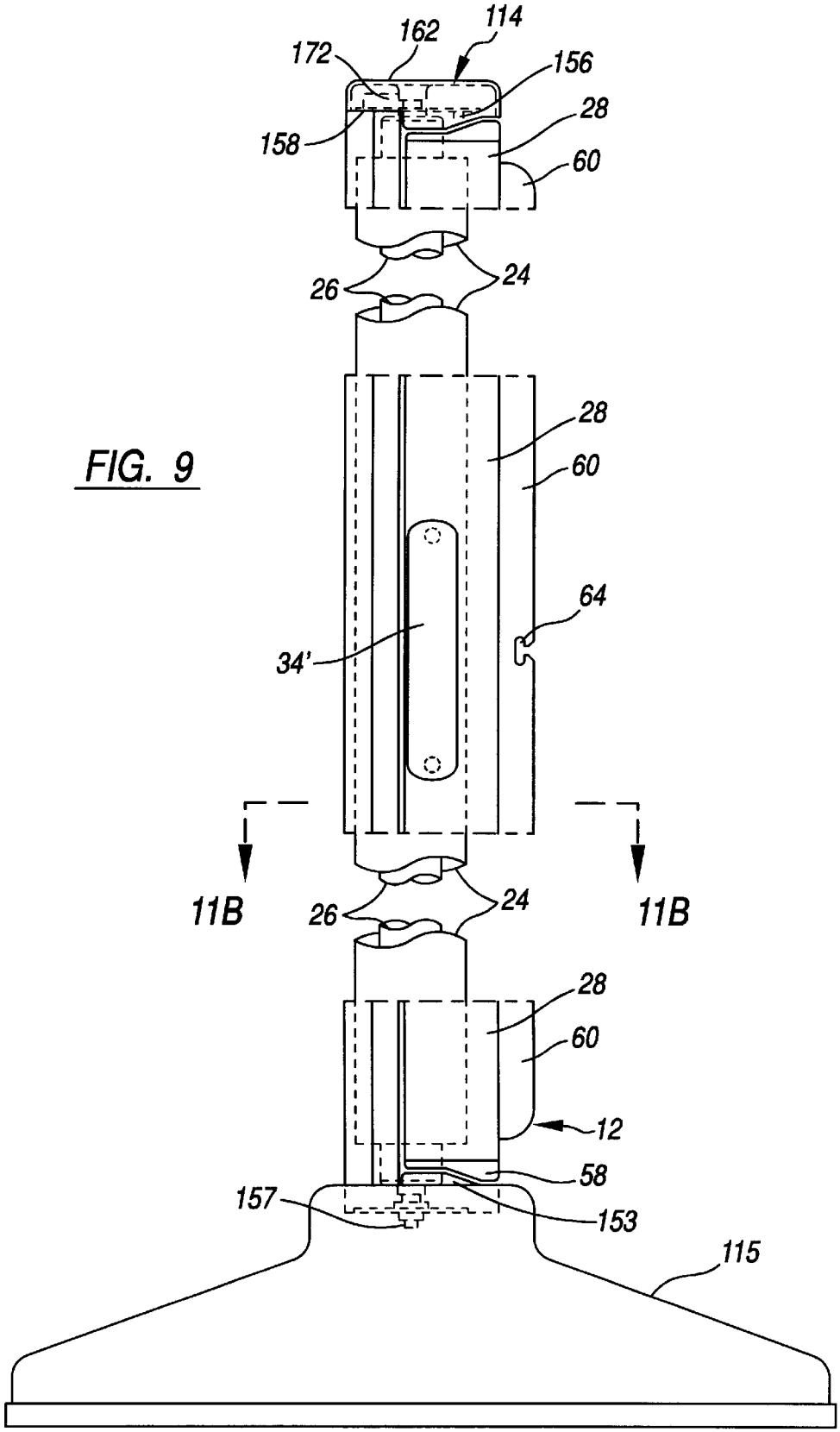
FIG. 9 is an enlarged elevational view, partially in cross-section with portions broken away and truncated in length for illustration purposes, showing a horizontally retractable panel and a housing mounted on a free standing base member.

The system shown in FIGS. 1 and 2 includes two retractable panels 12*a* and 12*b* which emerge from housings 14 and 114 and which can be latched to a jamb strip 116 and 16, respectively. The details of the construction of housing 14 and how it is attached to modular panel 20 is illustrated in FIG. 3A. Housing 114 is attached to a free-standing base unit 115 as shown in FIGS. 9 and 11A and includes at least one jamb strip 116 as more fully discussed hereafter. Jamb strip 16 is attached to a vertical panel 22 as shown in FIG. 3B. Free-standing base unit 115 is positioned between vertical panels 20 and 22 to define two intervals 18*a* and 18*b*.

It should be understood that vertical panels need not be aligned or leveled with each other as more fully discussed hereafter for proper functioning of the visual privacy system of the present invention so long as at least one interval is defined in the modular open plan furniture arrangement. Furthermore, it should be understood that the present invention can be used in ways other than having a retractable panel attached to a vertical modular panel. For example, a plurality of free-standing base units each comprising a base member 115 and a housing 114 attached thereto which contains a retractable panel 12*b* can be utilized together to form a grid system having a desired shape. Such a base unit can be used in conjunction with a jamb strip 16 mounted on vertical panels of a typical furniture arrangement to expand the range of its uses. Also, a retractable panel mounted on a vertical panel can be secured in a closed position adjacent to a housing 114 attached to a base member 115 in an open plan furniture arrangement.

Figure 6:
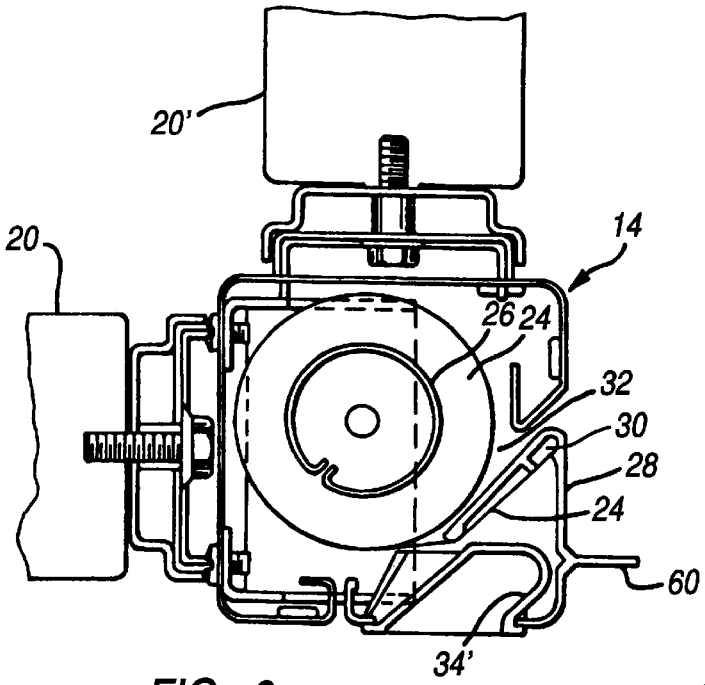
FIG. 6 PRIOR ART

Referring to FIGS. 3A and 6, each retractable panel 12*a*–*b* can comprise a length of flexible material 24 wound onto a vertically oriented, spring loaded roller 26. Each roller 26 is mounted in a fixed housing 14 or the housing 114 of the free-standing base unit 115 (FIG. 9), each of which is sized approximately to accommodate the desired quantity of flexible material 24. One end of each retractable panel 12*a*–*b* is secured to roller 26.

Figure 14B:
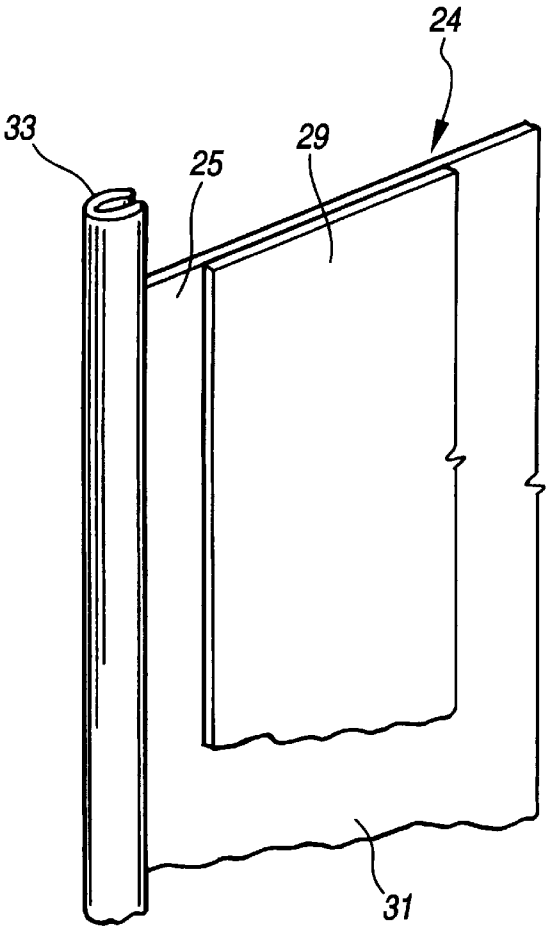
FIG. 14A illustrates the construction of the retractable panel and an exploded view of the spring loaded roller to which the retractable panel is attached.
FIG. 14 is a pictorial illustration of a corner segment of the laminated retractable panel with the fabric sectioned shorter in the right and lower directions to reveal the substrate.
Figure 14A:
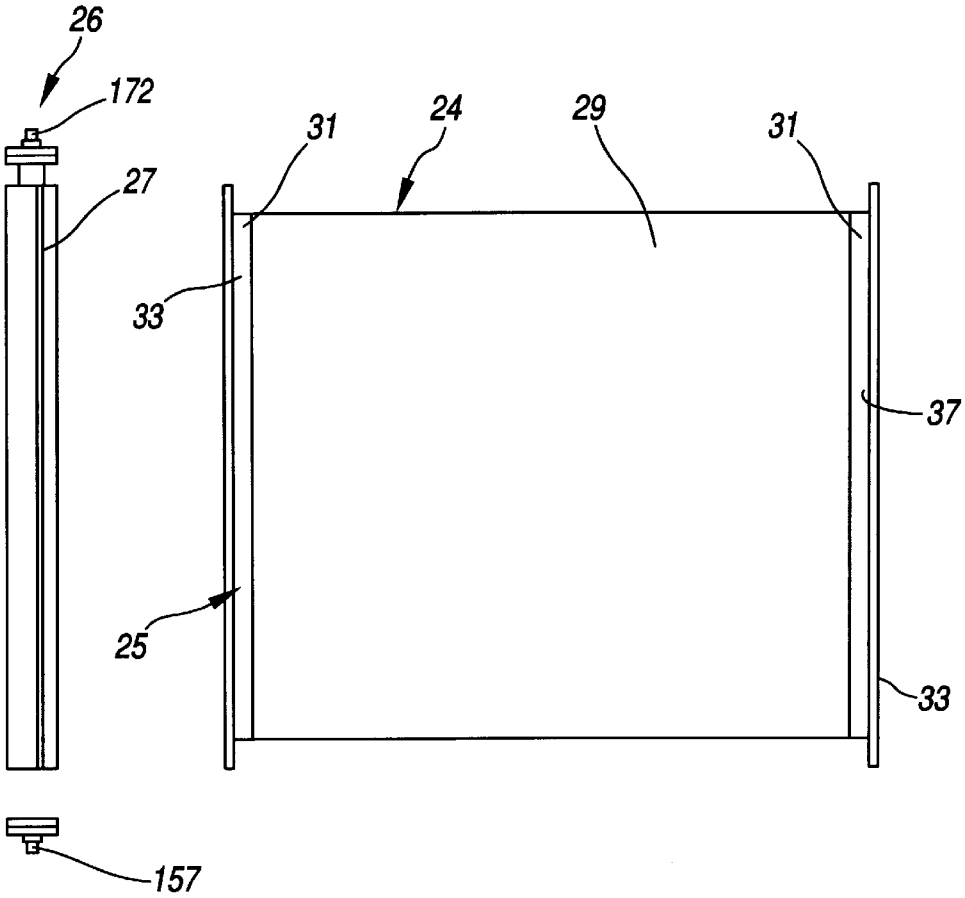

FIGS. 14A–14B illustrate an embodiment of the invention which permits the retractable panels to be joined to a corresponding roller in a uniform way. In this embodiment, the flexible material 24 comprises a layer of decorative material 29 which is laminated to a layer of backing material 31. Preferably, the backing material 31 has a uniform thickness and a variety of fabrics or other suitable materials of differing thicknesses can be used as the decorative material.

The flexible material 24 easily can be joined to roller 26 by extending the backing layer 31 slightly beyond fabric layer 29 at end 25 to which a crimp 33 is attached. Crimp 33 is slidably engagable with a close-fitting dovetail 27 in roller 26. Connecting crimp 33 to backing material layer 31 instead of to layers 29 and 31 together significantly reduces manufacturing costs and inventory problems due to the uniformity of the thickness of the backing material. Similarly, the other end of flexible material 24 easily can be joined to edge member 28 (FIG. 6) by extending layer 31 slightly beyond layer 29 to form a second end 37. A second crimp 33 is attached to end 37 and is slidably engagable with a close-fitting dovetail 30 (FIG. 6) in edge member 28.

The backing layer 31 comprises a material having a high stiffness to weight ratio and a high tensile strength which is, preferably, polyester film having a thickness from 0.003 to 0.010 inches. In the preferred embodiment, the polyester film is 0.007 inches thick. Laminating a fabric layer 29 to a polyester film backing layer 31 of this thickness minimizes drooping of a deployed retractable panel due to the high strength and light weight provided by the polyester film.

Each housing 14 includes internal brackets 44 and end caps 38 and 40 as shown in FIGS. 3A through 5 which permit the ends of roller 26 corresponding thereto to be held in place. The housing end caps 38 and 40 serve to guide seating guide 56 and 58 of edge member 28 into proper orientation relative to the housing. A housing 114 can include a top end cap 38 as discussed above. Further details concerning the subject matter mentioned above and how a retractable panel 12 is mounted within a housing 14 or 114 can be found in U.S. Pat. No. 5,275,220.

Each edge member 28, as shown in FIG. 3A, includes a tongue portion 60 having a T-shaped latch slot 64 which engages a latch pin 66 as shown in FIG. 3B. Pin 66 spans a longitudinal groove 62 in a jamb strip 16 which is attached to a vertical panel 22. Reference is made to U.S. Pat. No. 5,275,220 for a specific discussion of the interaction of an edge member 28 with a corresponding jamb strip 16 and the achievements afforded by the subject matter disclosed in FIG. 3A to FIG. 8.

Figure 11B:
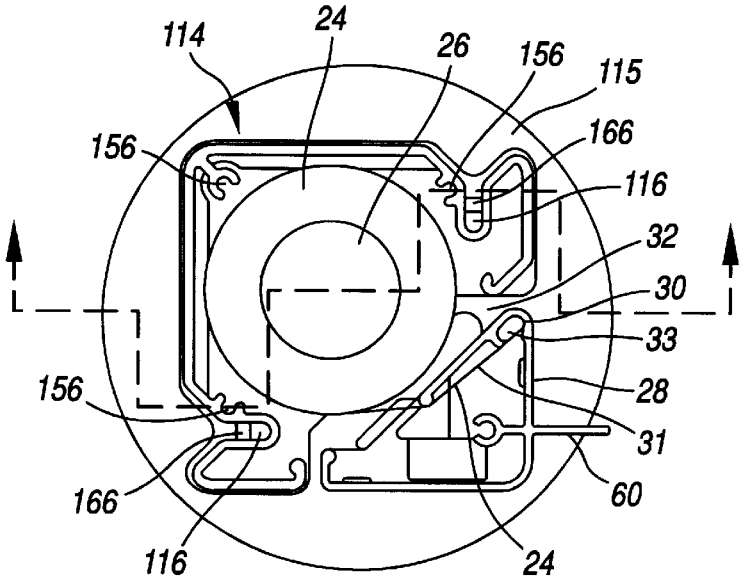
FIG. 11B is a cross-sectional view of the housing illustrated in FIG. 9 taken along lines 11B—11B.
Figure 11A:
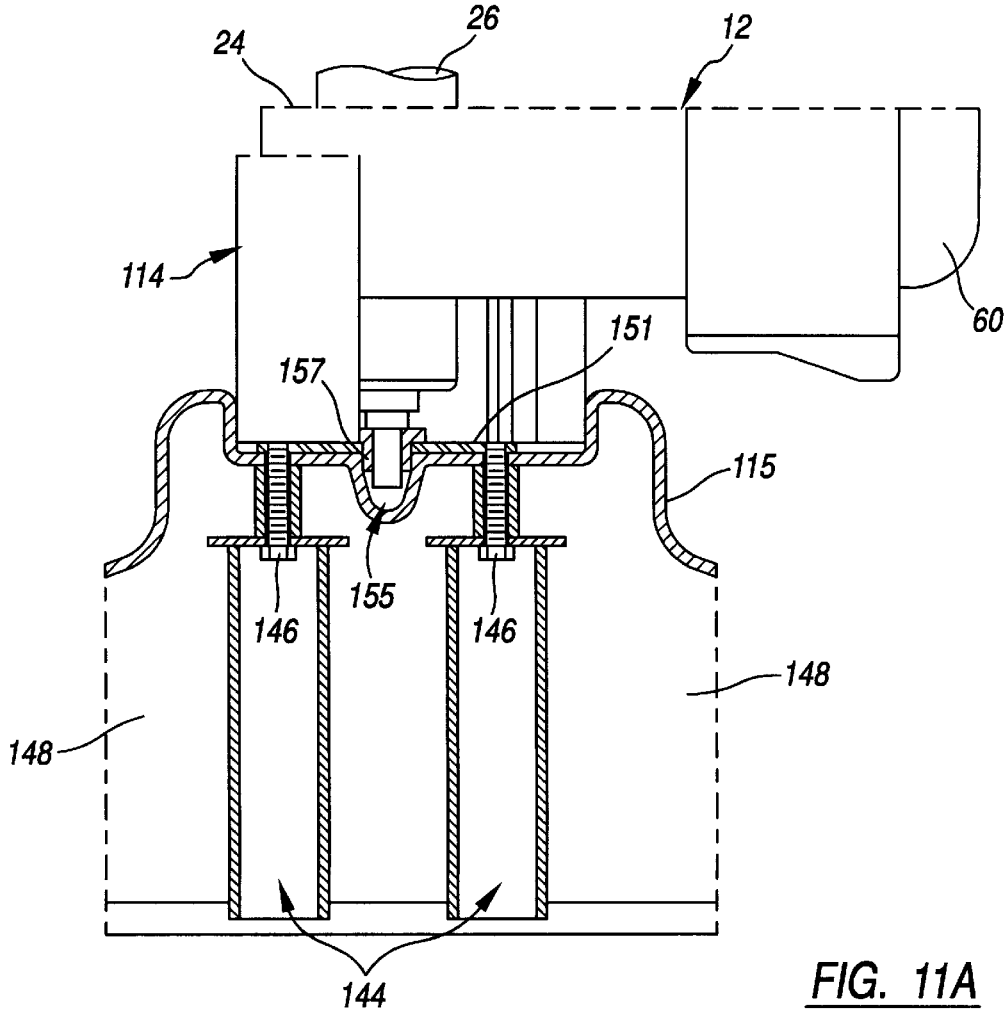
FIG. 11A is an elevational view, partially in cross section with portions broken away showing the connection of a housing to the base member of FIG. 9.

FIGS. 9 and 11A–11B illustrate an embodiment of the invention wherein a retractable panel is mounted in a housing 114 which is attached to a free-standing base unit 115. The features that housing 114 (shown in FIGS. 9 and 11A–11B) have in common with housing 14 (illustrated in FIGS. 3A–3B) are denoted by the same reference numerals.

Free-standing base unit 115 has two functions in that it must have a sufficient combination of weight and radial distance to its fulcrum point so that it has a much greater tip resistant moment than the horizontal load applied to housing 114 by the tension of a retractable panel 12 deployed therefrom. The horizontal load can be increased by latching one or more retractable panels to latch pins 116 which are located generally in the vertical center region of jamb strips 116 that are a part of the housing 114. In use, the horizontal tension is selected by balancing the force necessary to ensure that a retractable panel will be tight and not droop when deployed with the fact that physically impaired users may not have the strength to draw the panel across an interval to a closed position. For example, assuming a maximum tension of about five pounds, a latch height of about thirty-four inches, a diameter of base unit 115 of about sixteen inches, and two retractable panels latching to a housing 114 at ninety degrees from each other, a total combined weight of housing 114 and base unit 115 of about fifty pounds provides a reserve of tip resistance and a feeling of rigidity for the user.

Base unit 115 preferably comprises a plastic sheet which is thermal formed to the configuration illustrated in FIGS. 9 and 11A. As shown in FIG. 11A, base unit 115 includes a plurality of snorkels 144 which permit housing 114 to be detachably secured thereto by means of screws 146 and a depression 155 which receives axle pin 157 of roller 26. Configuring base unit 115 in this manner permits ballast 148 to be added thereto to provide the weight necessary for achieving the desired tip resistance. The ballast 148 can comprise metal shot or fine metal scrap that is bonded with epoxy. The epoxy binds the metal into a solid mass, bonds it to the inner side of the shell of base unit 115, and should prevent corrosion of the metal ballast thereby minimizing the risk of rust stains on the surface upon which the unit is positioned.

Figure 10:
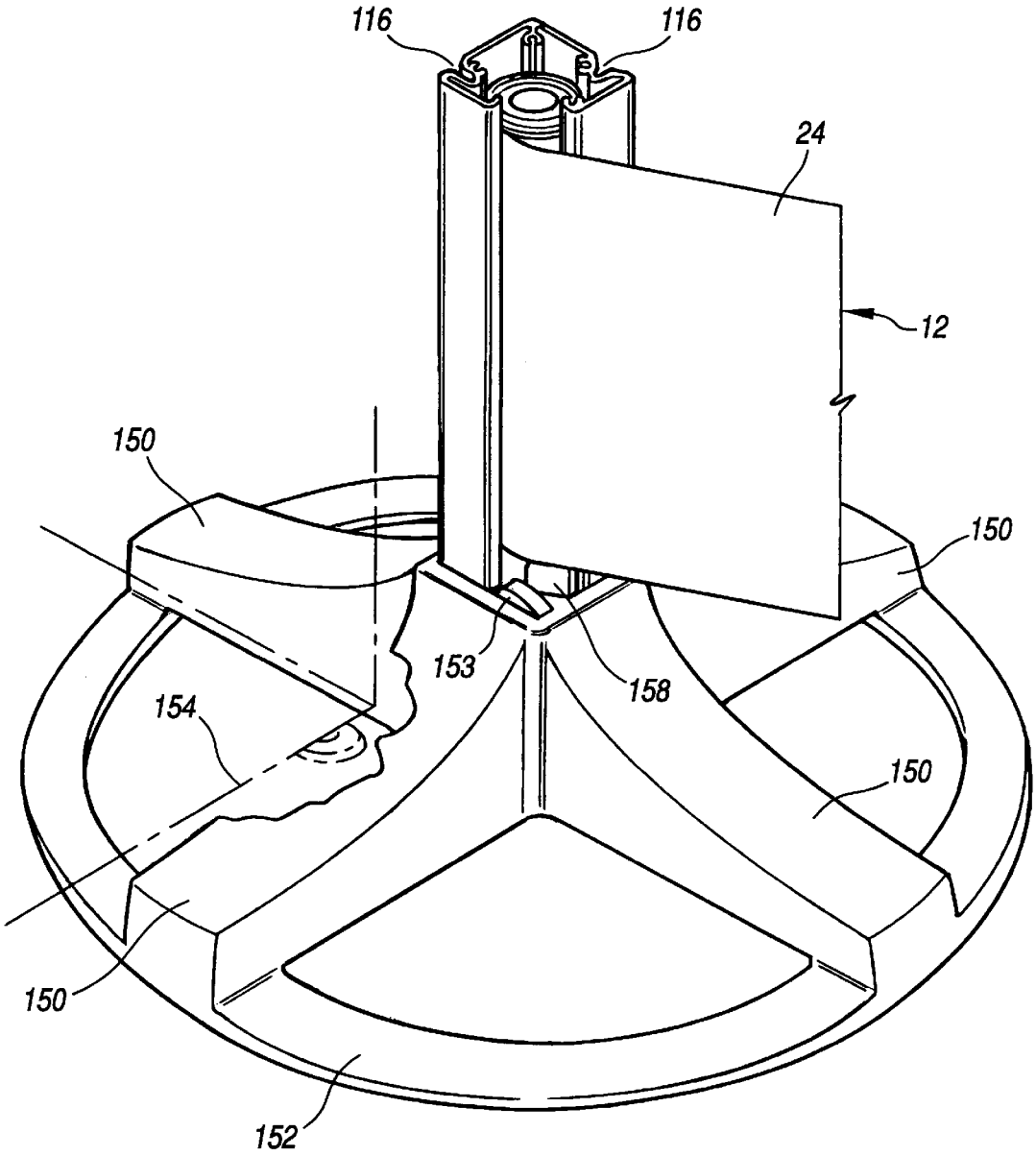
FIG. 10 is a perspective view showing an alternate configuration for the base member shown in FIG. 9.

Instead of using a thermally molded plastic sheet which contains ballast, base unit 115 can comprise cast metal of a desired weight. In this case, base unit 115 could be conical, cylindrical, octagonal or any other suitable shape. Furthermore, FIG. 10 illustrates an alternate base unit configuration in which a number of spokes 150 (four spokes are shown in FIG. 10) are attached to a flat rolling rim 152 which allows the unit to be tilted and rolled to a desired location. This configuration permits chairs or other pieces of furniture shown as item 154 (only one corner of which is shown in FIG. 10) to be placed closely to the inner corners of the base unit 115. Projections 153 and 158 on base unit 115 perform similar guide and align functions as those on the end cap in the '220 patent. It should be understood that other suitable materials and configurations can be utilized in the construction of a base unit 115.

Figure 15A:
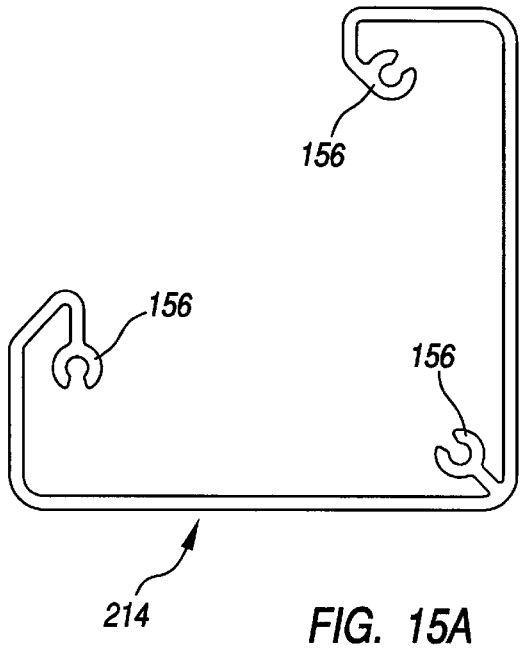
FIGS. 15A–15C respectively illustrate a cross sectional view of an extruded housing, a plan view of an end plate and a perspective view of an end cap which can be attached to the housing.
Figure 15B:
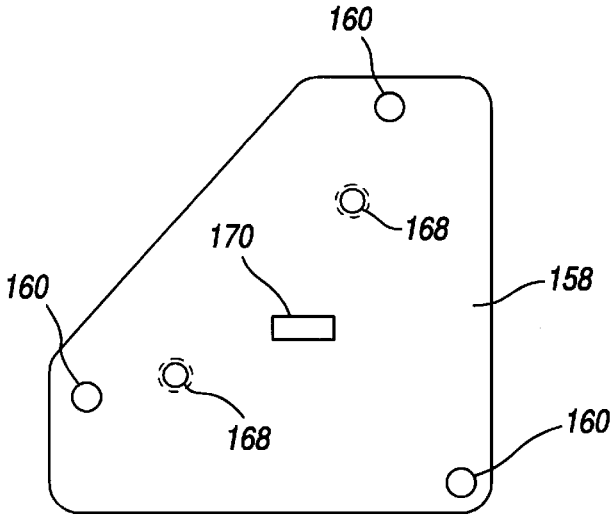
Figure 15C:
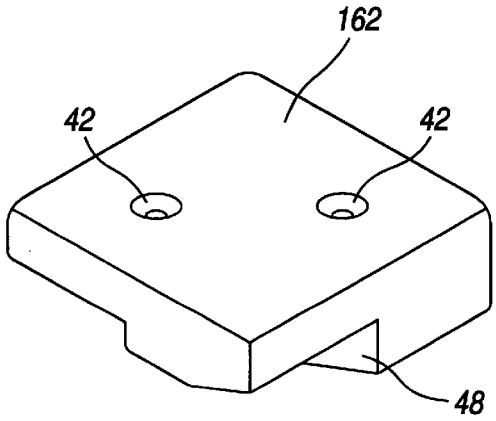

Referring to FIG. 3B and FIGS. 9 to 15A–D, the prior art housing 14 includes an internal bracket 44 to which an end cap 38 is attached by means of screws (not shown) through openings 42. The bracket 44 is secured to the housing 14 by screws 46. Housing 114 includes a number of integral screw bosses 156 which do not interfere with the deployment of a retractable panel therefrom. An end bracket 158 can be attached to housing 114 by inserting a screw (not shown) through each of the apertures 160 which correspond to an integral screw boss 156. End cap 162 can be secured to bracket 158 by inserting a screw (not shown) in each of its apertures 42, each of which corresponds to a tapped hole 168 in bracket 158. End bracket 158 includes a central aperture 170 for retaining a tension adjusting blade 172 of spring loaded roller 26. It should be understood that the functions of angle brackets 44 of the prior art are performed by the end bracket 158 and its corresponding bracket 151 at the opposite end. Bracket 151 has an aperture to mount a bushing for the axle pin 172 of roller 26. Similarly, as illustrated in FIGS. 15A and D, the housing 14 of prior art can have screw bosses 156 added to it to become housing 214 and cooperate with end bracket 158 as does housing 114. A corresponding end cap 163 is at the opposite end of the housing 114.

Figure 15D:
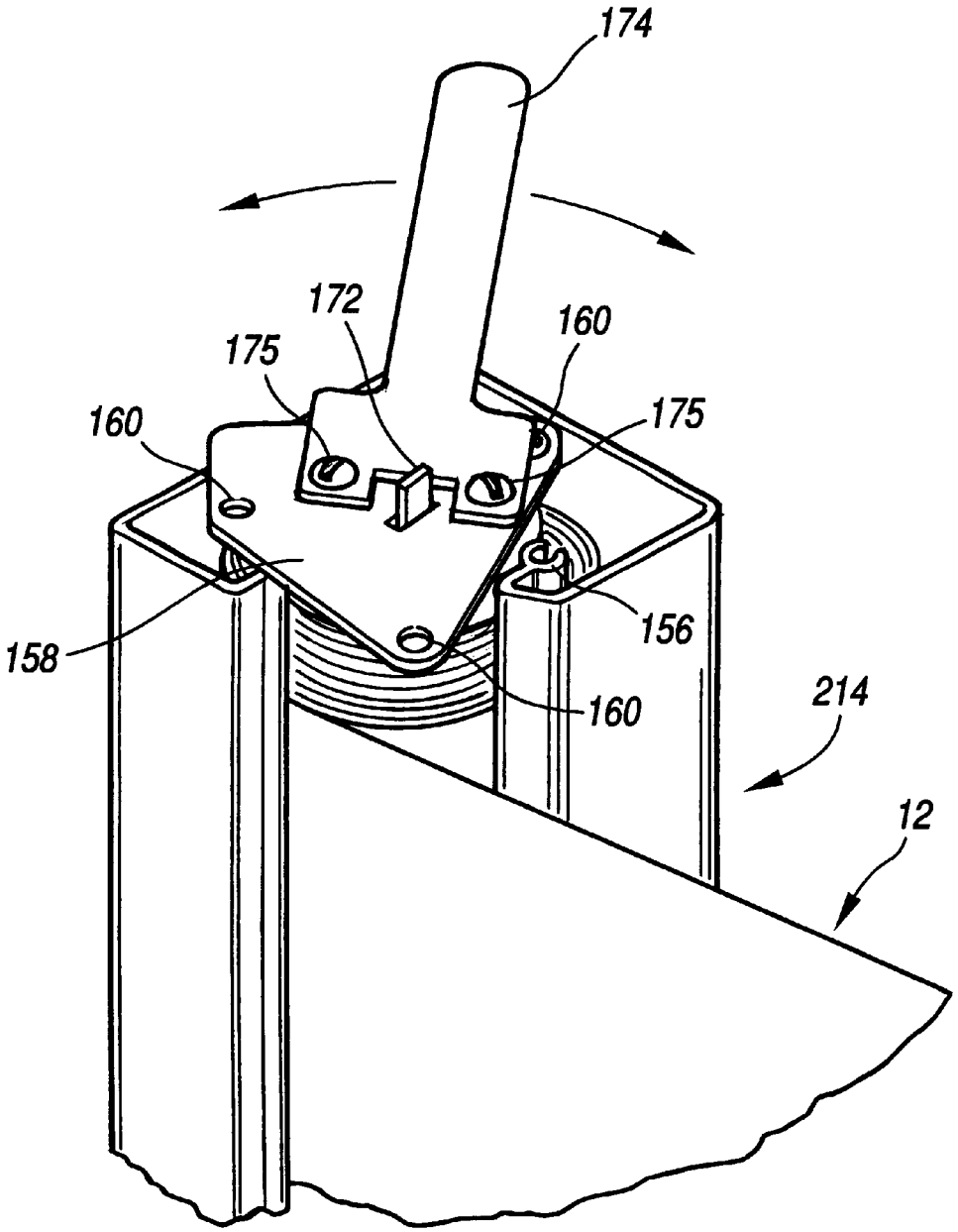
FIG. 15D is a perspective view of an extruded housing which illustrates how a user can change the tension of a spring loaded roller by rotating the end plate of FIG. 15B.

The attachment of end cap 162 and end bracket 158 to housing 114 as discussed above with reference to FIGS. 15A–15C permits a user to incrementally adjust the tension of the spring loaded roller 26 as illustrated in FIG. 15D. To adjust the tension of the roller, a user removes end cap 162 and attaches a handle 174 to end bracket 158 using screws (not shown) that are inserted in tapped holes 168 which normally are used to secure end cap 162. Then, the screws securing end bracket 158 to screw bosses 156 are removed thereby allowing the handle 174 to rotate end bracket 158 and spring blade 172. The tension of roller 26 can be incrementally adjusted by rotating handle 174 a series of complete revolutions in either direction. Once a new desired tension is reached, the end bracket 158 and end cap 162 are again secured to housing 114 (or housing 214).

Figure 7:
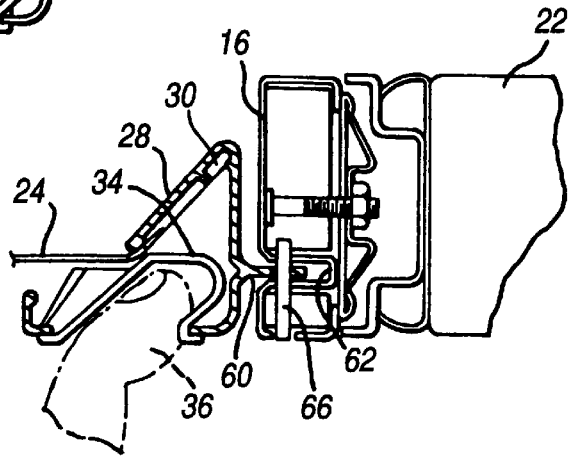
FIG. 7 PRIOR ART
Figure 8:
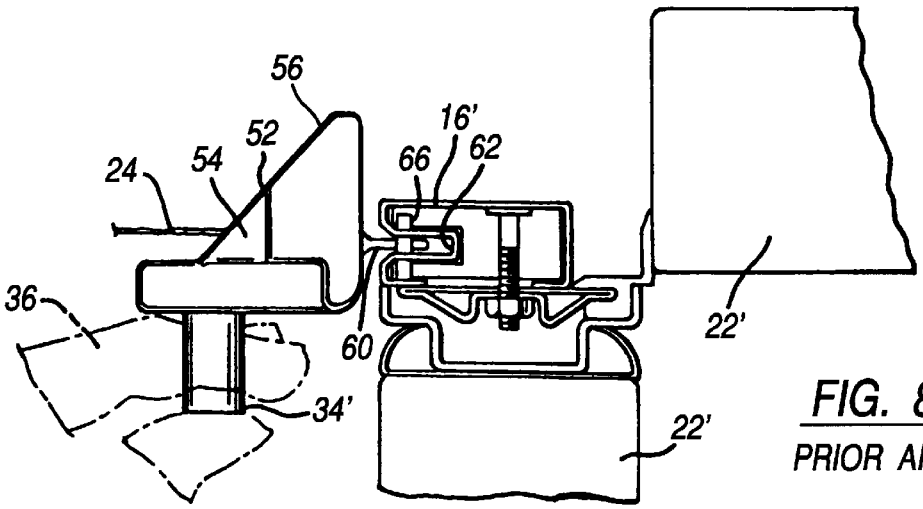
FIG. 8 PRIOR ART

Referring to FIG. 11B, a cross-sectional view of housing 114 is illustrated. The crimp 31 of flexible material 24 is captured within a longitudinal close fitting dovetail 30 formed in rigid edge member 28 as discussed above. A hand pull 34 (not shown in FIG. 1B) is attached to edge member 28 as shown in FIGS. 7 and 8. Member 28 is shaped to conform to the exterior of housing 114 so that when the flexible material 24 is retracted and edge member 28 is disposed across longitudinal gap 32 in housing 114, edge member 28 forms as closely as practical to a continuation of housing 114 in a manner similar to that disclosed in FIG. 6 and in U.S. Pat. No. 5,275,220.

Housing 114 includes one or more jamb strips 116 incorporated into its structure, two strips 116 being illustrated in FIG. 11B. Each of the jamb strips 116 comprises a vertical slot and a pull retaining latch means generally in the central zone of the slot so that an adjacent retractable panel 12 can be secured in one of the jamb strips 116 in a manner similar to that illustrated in FIG. 3B. While only one latching mechanism is shown, it should be understood that a number of other suitable structures exist which are obvious to one of ordinary skill in the art.

FIGS. 12A–13C illustrate two embodiments of the present invention in which the vertical latching point of a retractable panel to a jamb strip is made vertically adjustable. Providing such a vertically adjustable latch point permits the system disclosed in U.S. Pat. No. 5,275,220 to be used when the two panels that define an interval are not in vertical alignment. It should be appreciated that an equivalent to the above includes a spring loaded latch engaging a slot having a vertical length exceeding the expected maximum vertical misalignment.

Figure 12A:
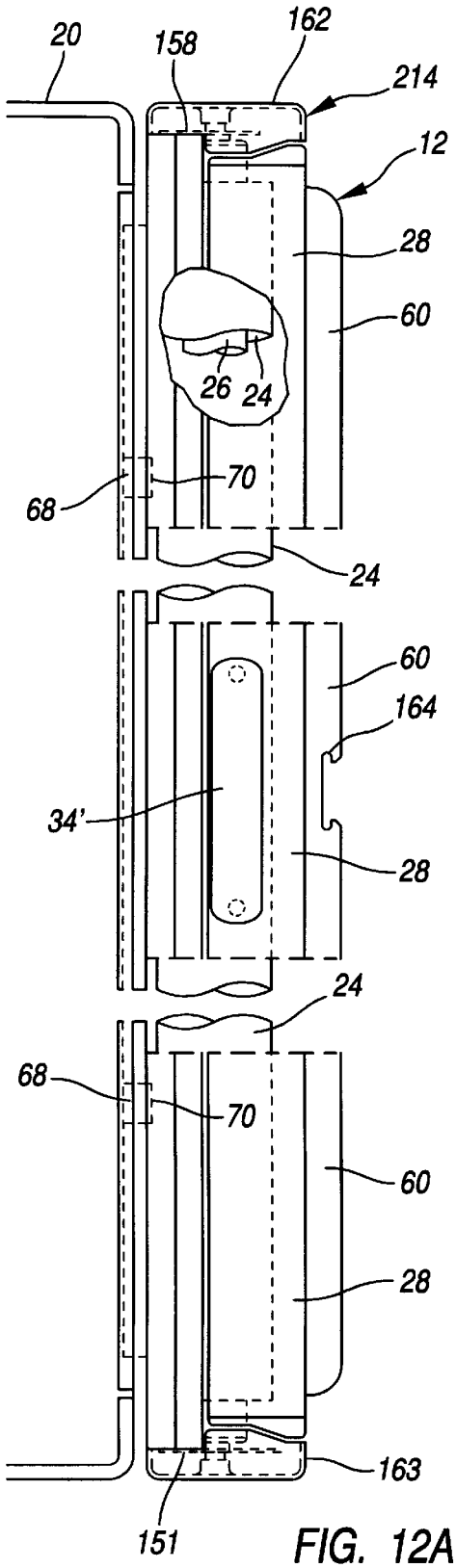
FIGS. 12A–12C illustrate an embodiment of the present invention which allows the latching point of a retractable panel to a jamb strip to be vertically adjusted.
Figure 12B:
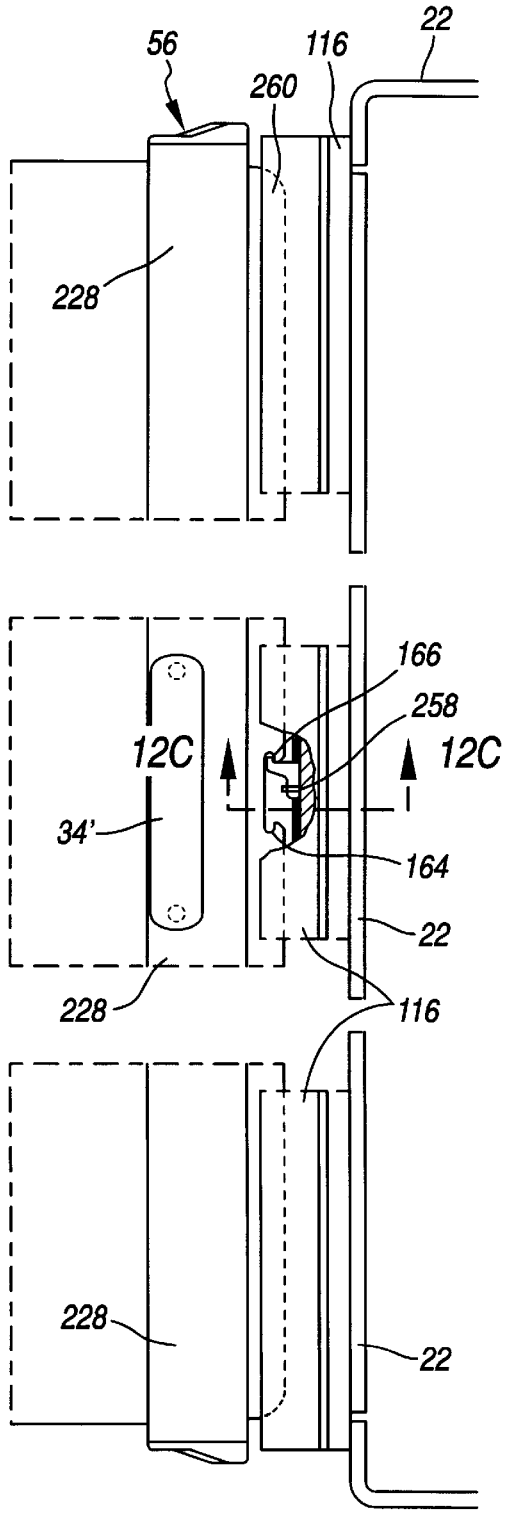
Figure 12C:
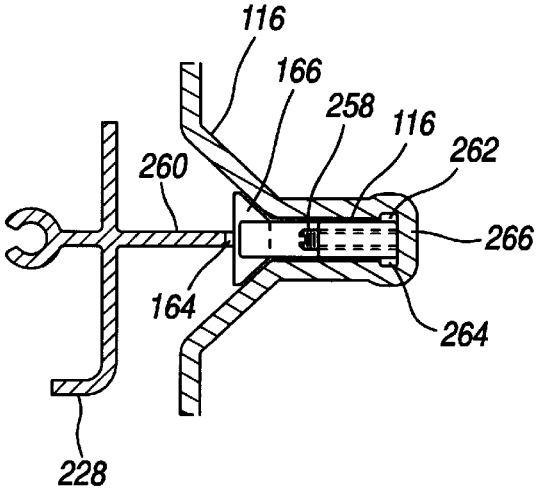

FIGS. 12A–12C illustrate two embodiments of the invention in which the latching point of a retractable panel 12 to a jamb strip 116 is made vertically adjustable. In this embodiment, tongue portion 260 of edge member 228 includes an elongated latch slot 164 which receives an adjustable die cast latch pin 166. A set screw 258 is provided to allow the vertical position of pin 166 relative to jamb strip 116 to be adjusted.

Referring to FIG. 12C, pin 166 includes a guide 262 which is received within guide groove 264 of jamb strip 116. The body of pin 166 is received within latch slot 164. When set screw 258 is fully inserted into pin 166, the set screw 258 bears against back wall 266 of jamb strip 116 to fix pin 166 at a desired vertical position in guide groove 264. The latch slot 164 is elongated to clear the balance of the body of pin 166 and to make engagement with it an easier task. It should be understood that other suitable materials, guiding means and contours can be utilized in making a vertically adjustable latch pin.

Figure 13B:
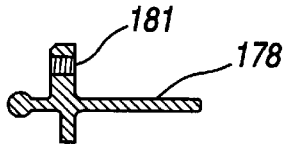
FIGS. 13A–13C illustrate a second embodiment of the invention which allows the latching point of a retractable panel to a jamb strip to be vertically adjusted.
Figure 13A:
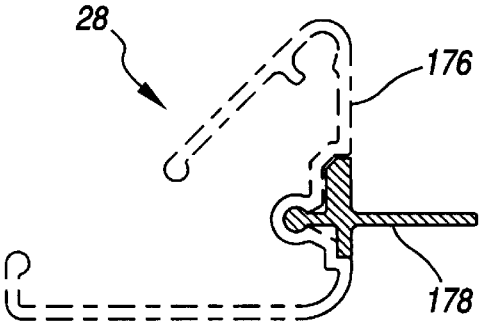
Figure 13C:
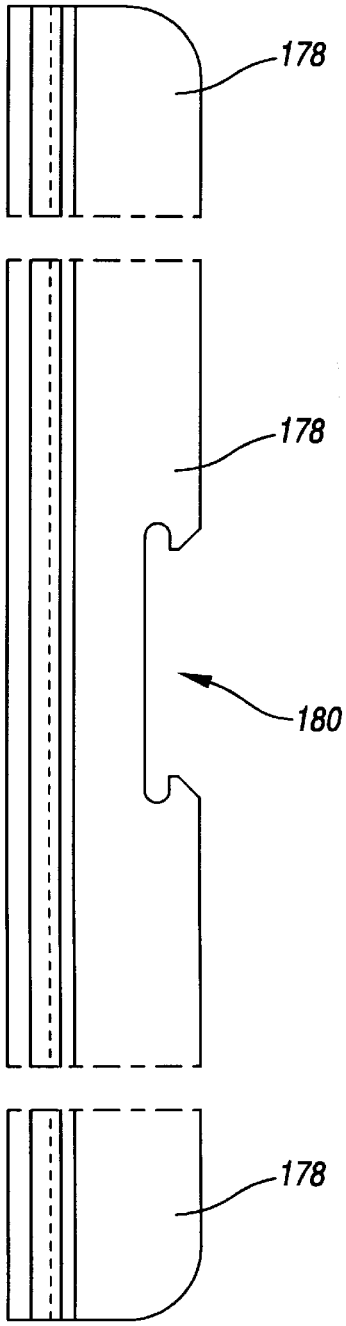

In the FIGS. 13A–13C embodiment of the invention, the rigid vertical edge member 28 comprises a pull extrusion 176 and a blade or tongue extrusion 178 that has a function similar to that of tongue 60 shown in FIGS. 3A–3B. Extrusions 176 and 178 are slidably engagable so that by adjusting their position with respect to each other, the vertical position of latch slot 180 in torque extension 178 is correspondingly adjusted relative to the latch pin (not shown). To secure tongue extrusion 178 in a desired position, a set screw (not shown) carried by one of the extrusions 176 and 178 and bearing upon the other one of extrusions 176 and 178 can be used. For example, the set screw can be inserted through a tapped aperture 181 of extrusion 178 to secure extrusion 178 to extrusion 176.

Figure 16B:
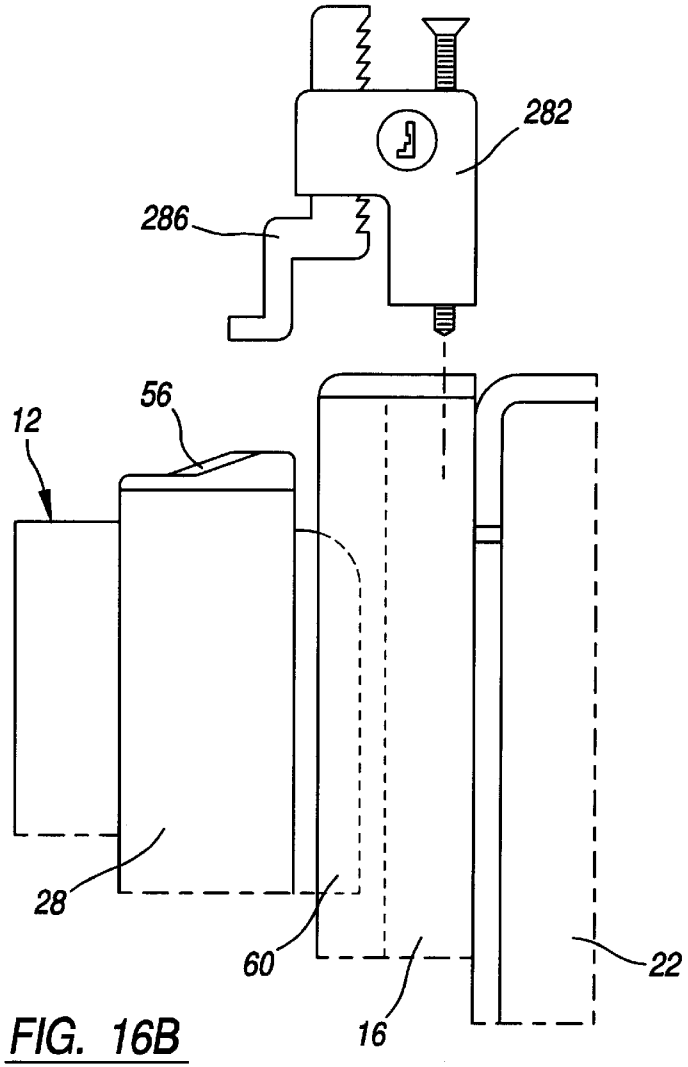
FIGS. 16A and 16B respectively illustrate an embodiment of the invention in which a lock is used to secure a housing and a jamb member to a modular panel corresponding thereto.
Figure 16A:
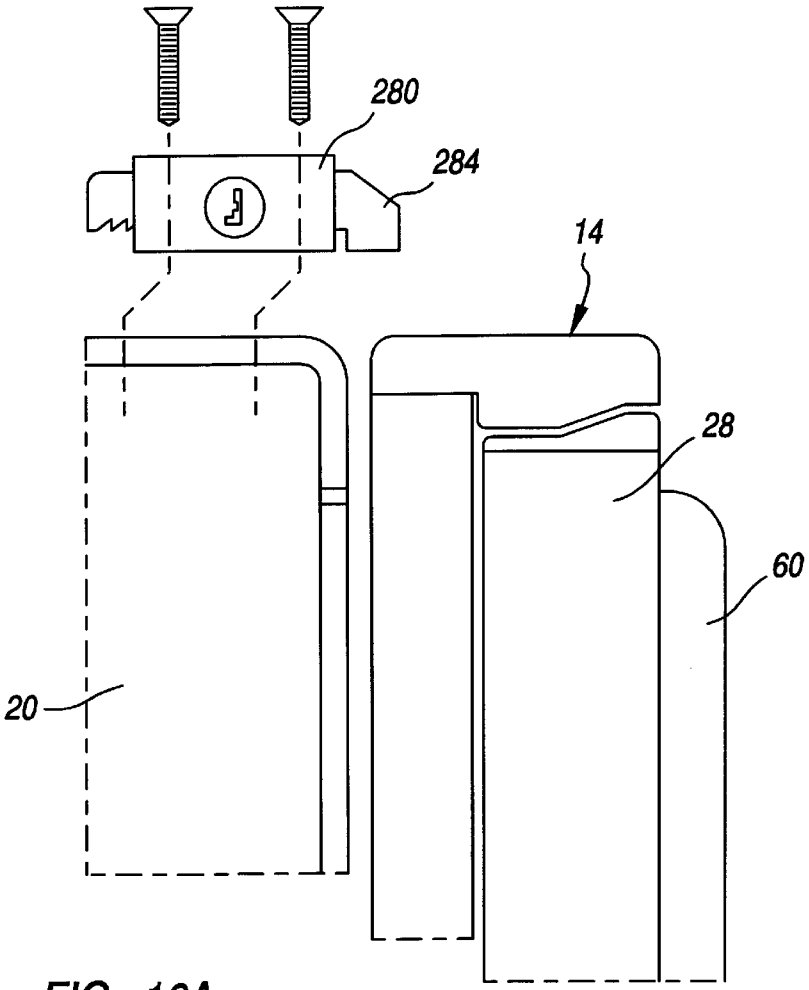

FIGS. 16A–16B illustrate an embodiment of the invention in which locks 280 and 282 may be fastened to the tops of panel 20 and jamb strip 16. The locks are used to prevent removal of a housing 14 from panel 20 and a retractable panel 12 from a closed position adjacent panel 22. Each of the locks 280 and 282 include an adjustable cam 284 and 286 corresponding thereto which can be moved and locked into engagement with the housing 14 and edge member 28 of retractable panel 12 to prevent them from being removed from the positions illustrated. The prior art illustrated housing 14 and edge member 28 require that they be raised to disengage them from their mating elements. In the illustrated embodiment, cams 284 and 286 lock the housing 14 and edge member 28 in place.

Figure 17:
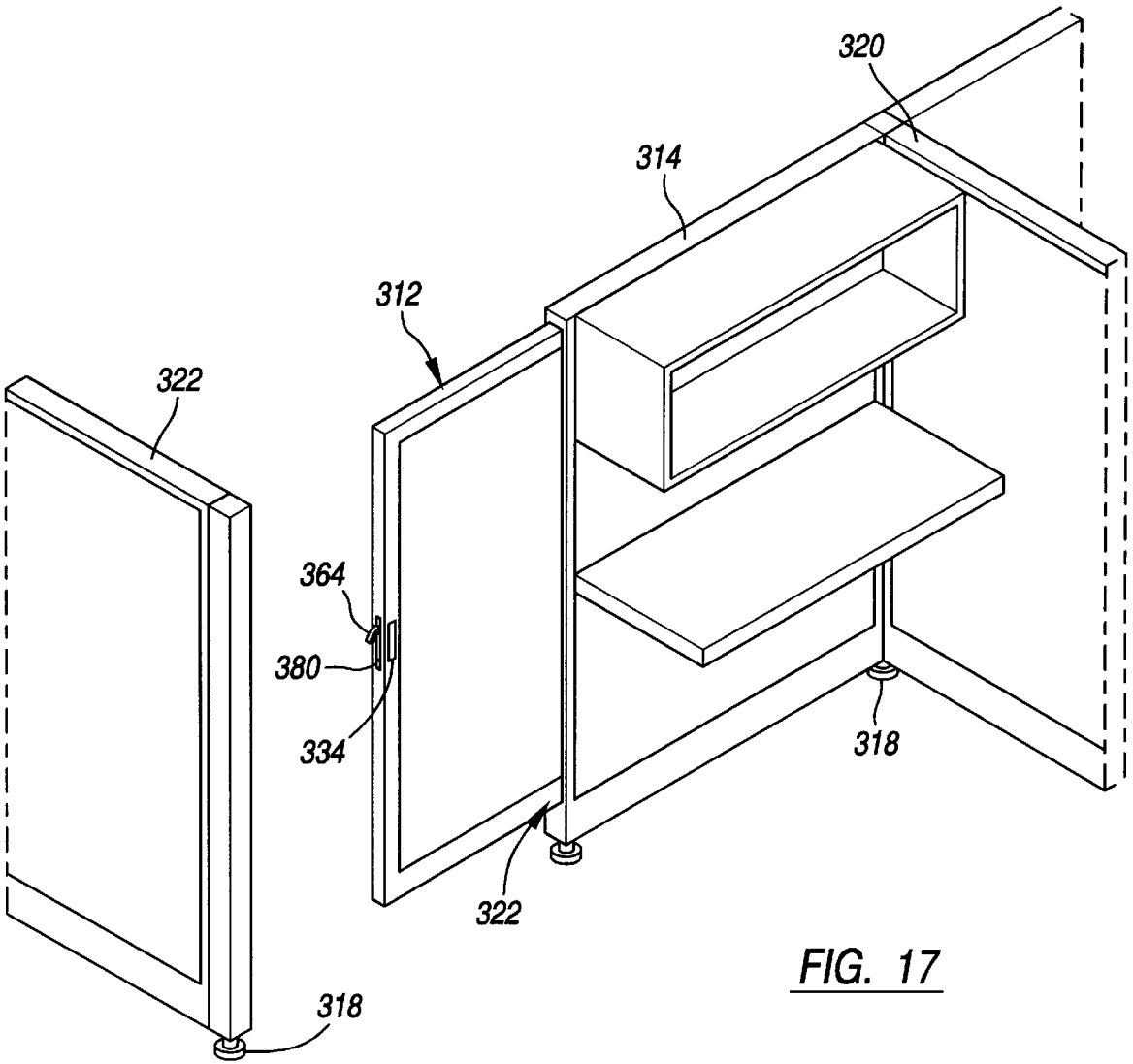
FIG. 17 is a perspective schematic view of a "pocket door" embodiment of the invention in which a retractable panel is slidably received within a pocket defined in a housing and its latch means has a provision for vertical adjustment.

FIG. 17 illustrates a "pocket door" embodiment of the invention in which a retractable panel 312 is slidably received within a pocket 332 of a housing 314 which is attached to a vertical panel 320 of an open plan furniture arrangement. Panel 312 can be drawn across an interval 318 defined between vertical panels 320 and 322 using handle 334 and secured in a closed position adjacent vertical panel 322. To secure retractable panel 312 in this position, a latch pin 364 is attached to panel 312 which can be received within a latch slot corresponding thereto (not shown) associated with vertical panel 322. As shown in FIG. 17, pin 364 is detachably coupled within mounting slot 380 to retractable panel 312 to allow its vertical position relative to panel 312 to be changed.

As shown in FIGS. 3A and 3B, housing 14 is attached to panel 20 by means of the engagement of slots 72 with the hooks 70 of brackets 68. Jamb strip 16 is attached to panel 22 by means of a plurality of nuts and bolts. Attaching housing 14 and jamb strip 16 in this manner fixes their vertical position relative to the vertical panel corresponding thereto.

Pairs of ferromagnetic strips of opposite polarity (not shown), one side of each strip containing a layer of adhesive, can be used to attach housing 14 and jamb strip to panels 20 and 22. If the vertical end surface of panels 20 and 22 or the housing 14 and jamb strip 16 are made of steel, one such ferromagnetic strip may be so employed in place of a pair of opposite polarity strips. The use of the ferromagnetic strips permits the vertical positions of housing 14 and jamb strip 16 relative to panels 20 and 22 to be adjusted. This allows the open plan furniture arrangement to be used on an uneven horizontal surface and permits panels 20 and 22 to be out of vertical alignment. Alternatively, a series of small magnets (not shown) could be used in place of brackets 68 and slots 72 to allow the housing and jamb strip to be secured to ferromagnetic surfaces such as a steel surface.

While the invention has been illustrated and described in detail in the drawings and foregoing description, the same is considered as illustrative and not restrictive in character, it being understood that only the preferred embodiments have been shown and described and that all changes and modifications that come within the spirit of the invention are desired to be protected.

What is claimed is:

1. A system for providing visual privacy across an interval between first and second vertical surfaces defined in an open plan furniture arrangement which is utilized on a generally horizontal surface, said system comprising:

a first retractable panel comprising a spring-loaded roller having a longitudinal channel and a flexible material having first and second ends coiled about said roller, said flexible material comprising a first material layer laminated to a second material layer, said second material layer extending beyond said first material layer at said first end and having a crimp secured thereto that is slidably engagable with said longitudinal channel to secure said first end of said flexible material to said roller;

a first housing having a longitudinal gap, said first housing to be secured to said first vertical surface and including means for mounting said first retractable panel within said first housing to permit it to be withdrawn and retracted through said longitudinal gap and deployed in at least one direction relative to said first housing;

first drawing means for drawing said first retractable panel across said interval; and first securing means for securing said first retractable panel to said second vertical surface in a closed position.

2. The system of claim 1 wherein said first drawing means includes an edge member having a longitudinal channel and wherein said second material layer extends beyond said first material layer at said second end and has a crimp secured thereto that is slidably engagable with said longitudinal channel of said edge member to permit said second end of said flexible material to be secured to said edge member.

3. The system of claim 1 wherein said second material layer comprises plastic film having a thickness from 0.003 to about 0.010 inches.

4. The system of claim 3 wherein said plastic film is polyester film having a thickness of about 0.007 inches.

5. A system for providing visual privacy in an open plan furniture arrangement, said system comprising:

a substantially vertically oriented first housing;

a substantially vertically oriented first securing member positioned in a generally parallel relationship to said first housing to define an interval between said first housing and said first securing member;

a first retractable panel;

said first housing having a longitudinal gap, said first retractable panel being mounted within said first housing to permit it to be withdrawn and retracted through the longitudinal gap in said first housing and deployed in multiple directions relative to said first housing;

first and second latch members which are attached to generally central portions of said first retractable panel and said first securing member, respectively, and are operatively engageable to secure said first retractable panel in a closed position wherein said panel lies in a substantially vertical plane to provide visual privacy across the interval between said first housing and said first securing member when said first retractable panel is drawn across the interval between said first housing and said first securing member, the generally central portions of said first retractable panel and said first securing member being located adjacent the vertical midpoints of said first retractable panel and said first securing member, respectively; and wherein the position of one of said first and second latch members with respect to said first retractable panel and said first securing member, respectively, is slidably adjustable, whereby the position of said one of said first and second latch members is adjusted in an amount corresponding to at least some of the vertical separation between said first and second latch members when said first retractable panel is deployed across the interval between said first housing and said first securing member to generally reduce sagging in said first retractable panel when it is disposed in said closed position.

6. The system of claim 6 wherein said first housing is mounted on a moveable free-standing base unit.

7. The system of claim 6 wherein said moveable free-standing base unit includes a central hub having at least one spoke extending therefrom and a generally circular member attached to said at least one spoke.

8. The system of claim 6 wherein said first securing member is mounted on a moveable free-standing base unit.

9. The system of claim 8 wherein said moveable free-standing base unit includes a central hub having at least one spoke extending therefrom and a generally circular member attached to said at least one spoke.

10. The system of claim 6 wherein said first securing member is mounted on a vertical surface defined on a furniture panel of an open plan furniture arrangement.

11. The system of claim 5 wherein said first housing is mounted on a vertical surface defined on a furniture panel of an open plan furniture arrangement.

12. The system of claim 11 wherein said first securing member is mounted on a moveable free-standing base unit.

13. The system of claim 12 wherein said moveable free-standing base unit includes a central hub having at least one spoke extending therefrom and a generally circular member attached to said at least one spoke.

14. The system of claim 11 wherein said first securing member is mounted on a vertical surface defined on a furniture panel of an open plan furniture arrangement.

15. The system of claim 5 further comprising a second retractable panel, wherein said first securing member is mounted on a substantially vertically oriented second housing, and wherein said second housing has a longitudinal gap, said second retractable panel being mounted within said second housing to permit said second retractable panel to be withdrawn and retracted through the longitudinal gap in said second housing and deployed in multiple directions relative to said second housing.

16. The system of claim 15 further comprising a second securing member positioned in a generally parallel relationship to said second housing to define an interval between said second housing and said second securing member, said system further comprising third and fourth latch members which are attached to said second retractable panel and said second securing member, respectively, and are operatively engageable to secure said second retractable panel in a closed position wherein said panel lies in a substantially vertical plane to provide visual privacy across the interval between said second housing and said second securing member when said second retractable panel is drawn across the interval between said second housing and said second securing member.

17. The system of claim 16 wherein the position of one of said third and fourth latch members with respect to said second retractable panel and said second securing member, respectively, is adjustable, whereby the position of said one of said third and fourth latch members is adjustable in an amount corresponding to at least some of a vertical separation between said third and fourth latch members when said second retractable panel is deployed across the interval between said second housing and said second securing member to generally reduce sagging in said second retractable panel when it is disposed in said closed position.

18. The system of claim 5 wherein said first retractable panel comprises a generally flexible material coiled about a spring-loaded roller having a tension adjusting blade at one end thereof, the means for mounting in said first housing further including an end plate which is detachably secured to said first housing and has an aperture for receiving said tension adjusting blade to maintain a first desired tension on said roller when said endplate is secured to said first housing, said system further comprising a tension adjusting member which is operatively engageable with said endplate so that said first desired tension is maintained and is changeable to a second desired tension when said endplate is detached from said housing.

19. The system of claim 5 wherein said first and second latch members comprise a latch slot and a latch pin, respectively.

20. The system of claim 19 wherein said latch slot is formed in an edge member that is attached to one of said first retractable panel and said first securing member, the position of said edge member with respect to said one of said first retractable panel and said first securing member being adjustable.

21. The system of claim 20 further comprising a set screw, whereby the position of said edge member is adjusted by loosening said set screw, moving of said edge member, and tightening of said set screw.

22. The system of claim 19 wherein said latch pin is mounted on one of said first retractable panel and said first securing member, the position of said latch pin with respect to said one of said first retractable panel and said first securing member being adjustable.

23. The system of claim 22 further comprising a set screw, wherein the position of said latch pin is adjusted by loosening said set screw, moving said latch pin, and tightening said set screw.

* * * * *

UNITED STATES PATENT AND TRADEMARK OFFICE

CERTIFICATE OF CORRECTION

PATENT NO. : 6,012,504

DATED : Jan. 11, 2000

INVENTOR(S) : Siegal

It is certified that error appears in the above-indentified patent and that said Letters Patent is hereby corrected as shown below:

ON THE TITLE PAGE

Item [57]

In the Abstract, at line 8, change "or" to --for--

Col. 3, line 16, should read ... desired --tension-- is reached.

Col. 4, line 30, change "modular" to read --vertical--

Col. 5 line 58, change "116" to --166--

Col. 6, line 21, change "molded" to read --formed--

Col. 6, line 37, change "3B" to read --3A--

Col. 6, line 41, change "114" to read --214--

Col. 6, line 44, change "114" to read --214--

Col. 6, line 55, change "172" to read --157--

Col. 6, line 58, change "114" to read --214--

Col. 6, line 59, change "114" to read --214--

Col. 6, line 61, change "114" to read --214--

Col. 6, line 66, change "(not shown)" to read --(175)--

Col. 7, line 9, change "31" to read --33--

Col. 7, line 12, change "FIG. 1B" to read --FIG. 11B--

Col. 7, line 66, change "torque extension" to read --tongue extrusion--

UNITED STATES PATENT AND TRADEMARK OFFICE

CERTIFICATE OF CORRECTION

PATENT NO. : 6,012,504

DATED : January 11, 2000

INVENTOR(S) : Siegal

It is certified that error appears in the above-indentified patent and that said Letters Patent is hereby corrected as shown below:

Col. 10, line 9, change "claim 6" to read --claim 5--

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*